US008104127B1

(12) United States Patent
Scanlan

(10) Patent No.: US 8,104,127 B1
(45) Date of Patent: Jan. 31, 2012

(54) SHEET METAL WORKING TOOL

(76) Inventor: Nim Scanlan, Rock Falls, IL (US)

( * ) Notice: Subject to any disclaimer, the term of this patent is extended or adjusted under 35 U.S.C. 154(b) by 274 days.

(21) Appl. No.: 12/394,351

(22) Filed: Feb. 27, 2009

(51) Int. Cl.
*B25D 1/04* (2006.01)

(52) U.S. Cl. ..... 7/146; 72/458; 81/3.55

(58) Field of Classification Search ..... 7/146–147; 72/457–459; D8/81, 88–89; 140/106, 123; 81/3.55, 3.48, 3.49, 3.57
See application file for complete search history.

(56) References Cited

U.S. PATENT DOCUMENTS

| | | | | |
|---|---|---|---|---|
| 1,286,488 | A | | 12/1918 | Amberg |
| 1,324,693 | A | | 12/1919 | Rush |
| 1,344,533 | A | | 6/1920 | Cole |
| 1,354,448 | A | | 9/1920 | Walt |
| 1,475,821 | A | * | 11/1923 | Hay ..... 72/477 |
| 1,616,653 | A | | 2/1927 | Frasier et al. |
| D138,186 | S | | 7/1944 | Rowlett |
| 2,937,004 | A | | 5/1960 | Striani |
| D199,019 | S | | 8/1964 | Marson |
| D202,324 | S | | 9/1965 | Steffen |
| D202,475 | S | | 10/1965 | Anderton |
| D226,161 | S | | 1/1973 | Paulsen |
| 3,710,407 | A | | 1/1973 | Reid |
| 3,769,644 | A | | 11/1973 | Case |
| 4,034,595 | A | | 7/1977 | Smith |
| 4,371,021 | A | | 2/1983 | Converse et al. |
| 4,492,132 | A | * | 1/1985 | Obey ..... 81/3.09 |
| 4,934,174 | A | | 6/1990 | Gronlund et al. |
| 5,394,729 | A | | 3/1995 | Eisenhower, Jr. |
| D507,167 | S | | 7/2005 | Richardson |

* cited by examiner

*Primary Examiner* — Debra S Meislin
(74) *Attorney, Agent, or Firm* — Marshall, Gerstein & Borun LLP

(57) ABSTRACT

A sheet metal working tool has a shaft with a first end and a second end, a striking tool attached to the first end of the shaft, and an opener attached to the second end of the shaft. The opener includes a flat plate with a first end and a second end and a C-shaped structure having a first-end and a second end, the first end of the flat plate and the first end of the C-shaped structure joined together with the second end of the plate spaced from the second end of the C-shaped structure.

2 Claims, 2 Drawing Sheets

SHEET METAL WORKING TOOL

BACKGROUND

This patent is directed to a sheet metal working tool, and, in particular, to a sheet metal working tool useful with Pittsburgh locks.

SUMMARY

According to an aspect of the present disclosure, a tool has a shaft with a first end and a second end, a striking tool attached to the first end of the shaft, and an opener attached to the second end of the shaft. The opener includes a flat plate with a first end and a second end and a C-shaped structure having a first-end and a second end, the first end of the flat plate and the first end of the C-shaped structure joined together with the second end of the plate spaced from the second end of the C-shaped structure.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
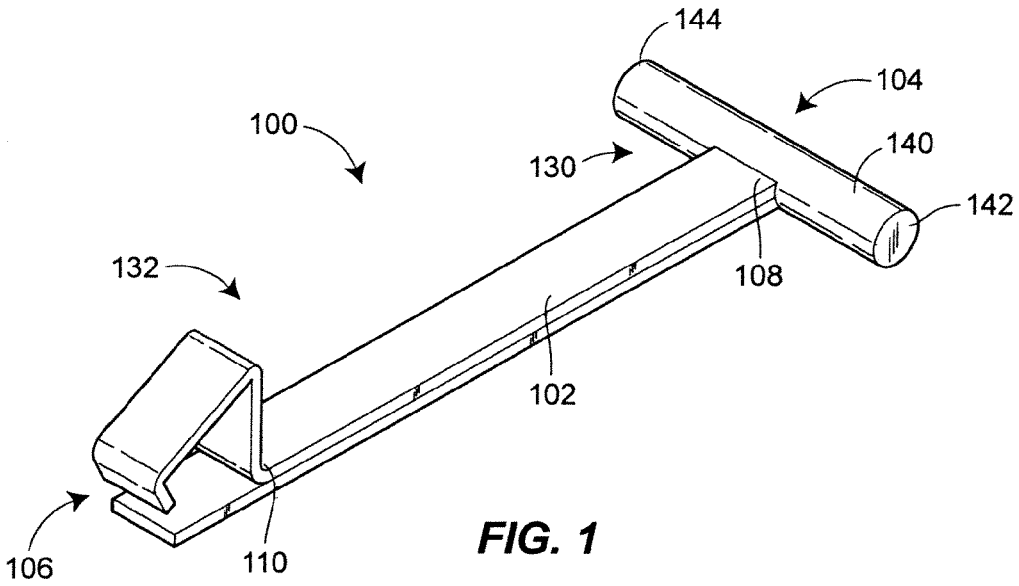
FIG. 1 is a perspective view of a tool useful for working with sheet metal.
Figure 2:
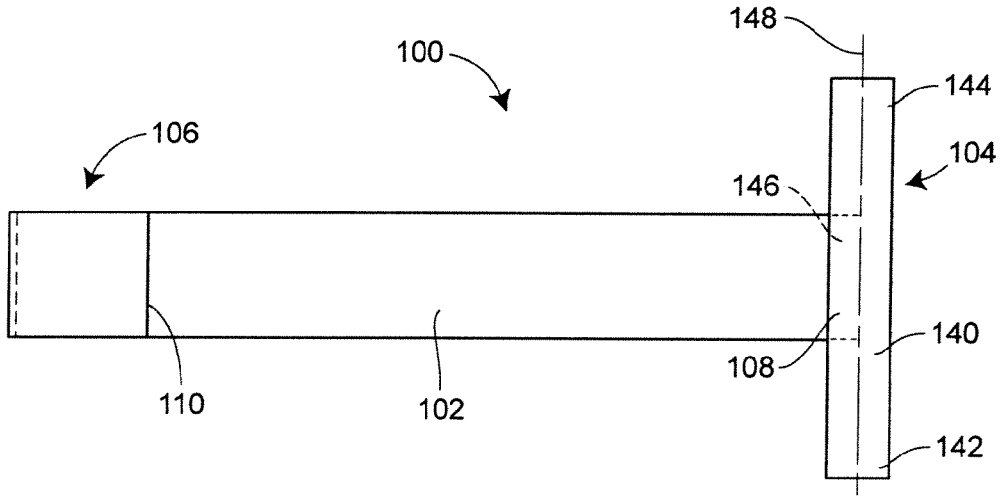
FIG. 2 is a plan view of the tool of FIG. 1.
Figure 3:
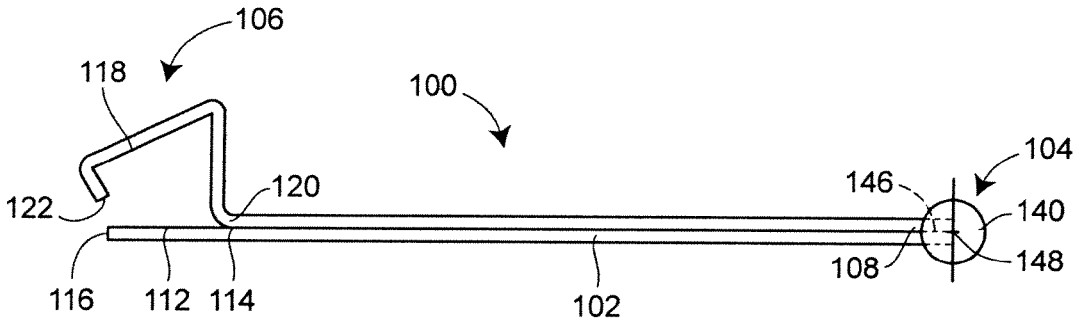
FIG. 3 is a side view of the tool of FIG. 1.

Referring first to FIGS. 1-3, a tool 100 for working with sheet metal is illustrated. The tool 100 includes a shaft 102, a striking tool 104, and an opener 106. In particular, the shaft

102 has a first end 108 and a second end 110. The striking tool 104 is attached to the first end 108 of the shaft 102, and the opener 106 is attached to the second end 110 of the shaft 102.

As best seen in FIG. 3, the opener 106 includes a flat plate 112 with a first end 114 and a second end 116. The opener 106 also includes a C-shaped structure 118 having a first end 120 and a second end 122. The first end 114 of the flat plate 112 and the first end 120 of the C-shaped structure 118 are joined together with the second end 116 of the plate 112 spaced from the second end 122 of the C-shaped structure 118.

Figure 4:
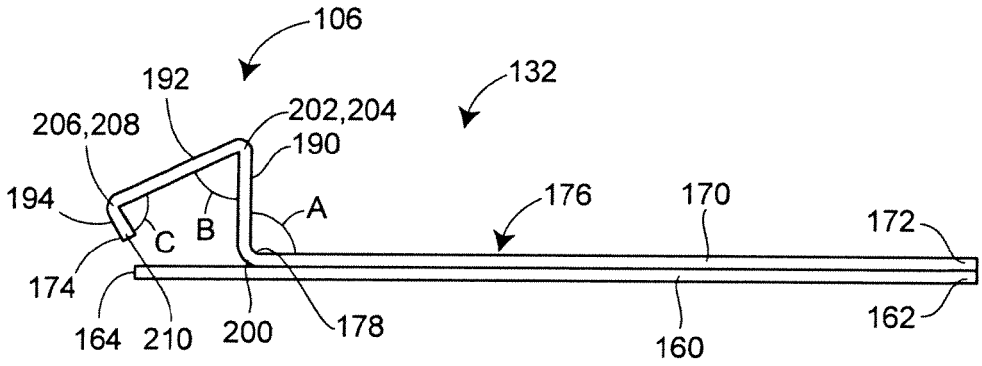
FIG. 4 is a side view of a subassembly of the tool of FIG. 1.

According to the illustrated embodiment, the tool 100 is constructed a first subassembly 130 and a second subassembly 132 (see FIG. 4). The first subassembly 130 defines the striking tool 104, while the second subassembly 132 defines the shaft 102 and the opener 106. The separation of the tool 100 into two subassemblies 130, 132 is intended to simplify manufacture, but should not be taken as limiting the ability of the tool 100 to be formed in a smaller or a greater number of subassemblies or in individual pieces.

In particular, as best seen in FIGS. 1 and 2, the first subassembly 130 includes a cylindrical bar 140 having a first end 142 and a second end 144. As illustrated, the first and second ends 142, 144 have the same shape, and thus either end may be used to strike another object to equal effect. It will be recognized that the first and second ends 142, 144 need not be similarly shaped according to other embodiments, with the first and second ends 142, 144 being shaped differently to perform different functions. The bar 140 also includes a slot 146 formed between the first and second ends 142, 144 parallel to a longitudinal axis 148 of the cylindrical bar 140 (see FIG. 2); the first end 108 of the shaft 102 is received in the slot 146 in the cylindrical bar 140.

Referring now to FIG. 4, the second subassembly 132 includes a first bar 160 having a first end 162 and a second end 164, the first bar 160 being flat between the first end 162 and the second end 164. The second subassembly 132 also includes a second bar 170 having a first end 172 and a second end 174, a flat section 176 between the first end 172 and a point 178 intermediate the first end 172 and the second end 174, and the C-shaped structure 118 formed between the point 178 intermediate the first end 172 and the second end 174 and the second end 174. The first bar 160 is attached to the second bar 170 with first ends 162, 172 and second ends 164, 174 aligned, although according to certain embodiments, the second end 174 may actually be disposed further to the left than the second end 164. According to those embodiments, the end 174 may be disposed to the left of the second end 164 at least the thickness of the sheet metal used to form the lock with which the tool 100 is used.

As to the C-shaped structure 118, this is defined in the following fashion. The second end 174 of the second bar 170 is bent so as to define three separate flat sections 190, 192, 194. In this fashion, the three sections 190, 192, 194 are not only attached to each other, they are integrally formed (i.e., all part of a single continuous piece). However, it will be appreciated that other embodiments may not be integrally formed, either among the sections 190, 192, 194 or with the remainder of the bar 170.

The first flat section 190 has a first end 200 attached to the flat section 176 of the second bar 170 and a second end 202, the first flat section 190 at a first, approximately right angle, indicated as A, to the flat section 176 of the second bar 170. The second flat section 192 has a first end 204 attached to the first flat section 190 of the C-shaped structure 118 and a second end 206, the second flat section 192 and the first flat section 190 forming at a second, acute angle, indicated as B, therebetween. The third flat section 194 has a first end 208 attached to the second flat section 192 of the C-shaped structure 118 and a second end 210, the third flat section 194 and the second flat section forming a third, acute angle, indicted as C, therebetween.

According to one embodiment, the second angle B may be approximately 75 degrees and the third angle C may be approximately 85 degrees. It will be recognized that this is merely one set of angles that may be used with an embodiment according to the present disclosure. Other angles may be used as well, acute, obtuse or right.

As for exemplary materials, the bar 140 may be made of high-carbon, heat-treated steel, such as is used in the manufacture of hammers and other striking/struck tools, for example. The first and second bars 160, 170 may also be made of steel, although not necessarily of a high-carbon steel. As a consequence, the bars 140, 160, 170 may be attached to each other through the use of a joining method, such as welding. Additionally, while not illustrated, a grip may be disposed about the first and second bars 160, 170, for example by layering a rubberized material over the bars 160, 170. It will be recognized that other materials may be used as well.

Figure 5:
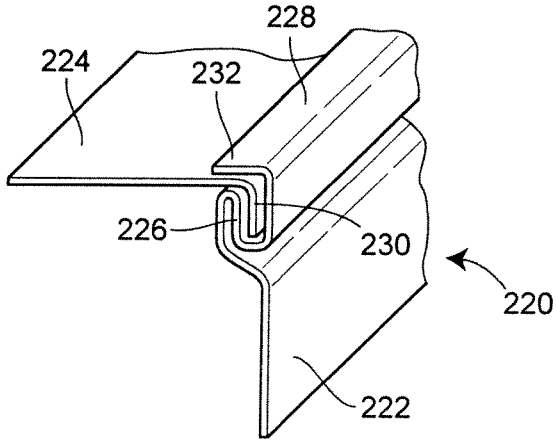
FIG. 5 is a cross-sectional view of a Pittsburgh lock, with which the tool of FIG. 1 may be useful.

In operation, the tool 100 is used to open and reform a Pittsburgh lock 220, such as may be illustrated in FIG. 5, as follows.

The Pittsburgh lock 220 is used to join a first section 222 of sheet metal and a second section 224 of sheet metal. The first section 222 has a pocket 226 formed along an edge of the section, with an adjacent flap 228 extending from the pocket 226, initially parallel to the remainder of the first section 222. The second section 224 has a flanged edge 230 that is turned at an approximately ninety degree angle to the remainder of the section 224. The edge 230 is disposed in the pocket 226, and the flap 228 is then bent over the edge 230 to form the finished lock 220 illustrated in FIG. 5.

It is often the case that the pocket 226 collapses prior to the insertion of the edge 230 of the section 224. For example, in the process of bending or rolling the section 222 to form a duct, the pocket 226 may be become flattened. In those instances, it is necessary to open the pocket 226 before the edge 230 may be inserted into the pocket 226.

In such a circumstance, the opener 106 is positioned with the end 122 inserted into the pocket 226 with the plate 112 abutting the section 222. Force is then applied to the shaft 102 using the end 116 as a fulcrum. Thus, if the tool 100 were used with the lock 220 illustrated in FIG. 5, the force would be applied to the shaft 102 to pivot the shaft 102 from left to right. The process would be repeated along the first section 222 as necessary to open the pocket 226 and straighten the flap 228.

It will be recognized that it is not necessary that the flap 228 be returned to an absolutely parallel relationship with the remainder of the first section 222 for one to refer to the flap as "straightened." Rather, it will be recognized that when the flap 228 is referred to as "straightened," this is in contrast to a situation where the flap 228 is limiting access to the pocket 226.

As for the striking tool 104, this may have more than one method of use in the forming of the lock 220. For example, the striking tool 104 may be used to force the edge 230 of the second section 224 into the pocket 226 in the first section 222. This action may be particularly difficult to perform, for example, when insulation is applied to one or both of the first and second sections 222, 224. In one variant, the striking tool 104 is used as a set—i.e., the striking tool 104 strikes the edge 230 in response to being struck by a hammer. According to this variant, the user would grasp the shaft 102 to steady the striking tool 104. According to another variant the striking tool 104 is used as a hammer—i.e., the shaft 102 is grasped and swung in the direction of the edge 230 to contact the striking tool 104 with the edge 230. Similarly, the striking tool 104 may be used either as set or hammer in bending over the flap 228 to complete the lock 220.

It is believed that the present disclosure may have several benefits, one or more of which may be present in a particular embodiment according to the present disclosure.

What is claimed is:

1. A tool comprising:

a shaft, having a first end and a second end;

a striking tool attached to the first end of the shaft; and an opener attached to the second end of the shaft, the opener including a flat plate with a first end and a second end and a C-shaped structure having a first-end and a second end, the first end of the flat plate and the first end of the C-shaped structure joined together with the second end of the plate spaced from the second end of the C-shaped structure, wherein a first subassembly defines the striking tool and a second subassembly defining the shaft and the opener, the second subassembly including:

a first bar having a first end and a second end, the first bar being flat between the first end and the second end, and a second bar having a first end and a second end, the second bar having a flat section between the first end and a point intermediate the first end and the second end and the C-shaped structure formed between the point intermediate the first end and the second end and the second end, the first bar attached to the second bar with first and second ends aligned; and wherein the C-shaped structure includes:

a first flat section with a first end attached to the flat section of the second bar and a second end, the first flat section at a first, approximately right angle to the flat section of the second bar;

a second flat section with a first end attached to the first flat section of the C-shaped structure and a second end, the second flat section and the first flat section forming a second, acute angle therebetween; and a third flat section with a first end attached to the second flat section of the C-shaped structure and a second end, the third flat section and the second flat section forming a third, acute angle therebetween.

2. The tool according to claim 1, wherein the second angle is approximately 75 degrees and the third angle is approximately 85 degrees.

* * * * *